United States Patent [19]

Pernet et al.

[11] 4,417,698

[45] Nov. 29, 1983

[54] WINDING PROCESS FOR CATHODE-RAY TUBE DEFLECTION RINGS

[75] Inventors: Didier Pernet, Auxonne; François Pater, Varois et Chaignot, both of France

[73] Assignee: Videocolor S.A., France

[21] Appl. No.: 256,375

[22] Filed: Apr. 22, 1981

[30] Foreign Application Priority Data

Apr. 22, 1980 [FR] France ..... 80 08964

[51] Int. Cl.[3] ..... H01F 41/06; B65H 81/08

[52] U.S. Cl. ..... 242/7.03; 242/7.14; 242/7.21; 140/92.1

[58] Field of Search ..... 242/7.03, 7.11, 7.14, 242/4 R, 4 B, 4 BE, 7.21, 7.22, 2; 140/92.2

[56] References Cited

U.S. PATENT DOCUMENTS

| | | | |
|---|---|---|---|
| 2,966,935 | 1/1961 | Wiltshire | 242/2 |
| 3,101,180 | 8/1963 | Sadorf | 242/7.14 |
| 3,128,056 | 4/1964 | Fahrbach | 242/7.14 |
| 3,299,379 | 1/1967 | Torsch et al. | 335/213 |
| 3,859,719 | 1/1975 | Gostyn | 242/4 R |
| 3,963,185 | 6/1976 | Quirk | 242/7.21 |
| 3,971,516 | 7/1976 | Rossaert | 242/7 B |

FOREIGN PATENT DOCUMENTS

| | | |
|---|---|---|
| 2234642 | 1/1975 | France . |
| 2351903 | 12/1977 | France . |
| 2361742 | 3/1978 | France . |

*Primary Examiner*—Billy S. Taylor

*Attorney, Agent, or Firm*—Pollock, VandeSande & Priddy

[57] ABSTRACT

The invention refers to a process and a machine making it possible to achieve improved winding of turns of electrical wire on a cathode ray tube deflection ring. According to the invention, the machine includes three axes X, Y, Z with motor means. The winders 12 rotate around axis Z to achieve turns of winding. They are supported by a rotatable column 11 around axis X to the winding plane. The deflecting ring 15 is mounted pivotally around axis X on a fixed support 4. The machine also includes pairing means for controlling electric motor means 5, 14. It is able to perform windings of desired incline without reducing the work speed of the winders 12.

4 Claims, 9 Drawing Figures

WINDING PROCESS FOR CATHODE-RAY TUBE DEFLECTION RINGS

FIELD OF THE INVENTION

The present invention concerns a process and a winding machine making it possible to achieve an improved winding, in particular for deflection rings for cathode-ray tubes.

BACKGROUND OF THE INVENTION

For many electromagnetic devices, deflection rings are utilized which consist of a ferrite pole core essentially in the shape of a truncated cone widened into a basin, onto which core a bundle of spirals is wound. To allow winding on winding machines, the firrite ring is initially divided into two parts, with each semicore thus having an open structure which can be wound on automatic winders; each semi-ring can thus be held on the winding machine by one of its lateral sections.

In windings presently done by machine, the turns are wound essentially along radial planes, i.e., passing through the axis of the truncated cone of the ring. Such an orientation of the turns is not advantageous electromagnetically, as it does not correspond to the best deflection output of the cathode-ray beam.

Of course it is possible to seek improvement in the performances of deflection rings by winding each turn on each semi-ring under the best orientations, for example by executing such a winding by hand. However, this would involve extremely long and costly operations hardly applicable industrially.

The object of the invention is to make is possible, without reducing the work speed of the winders of the machine, to obtain wound parts, in particular such as deflection rings for cathode-ray tubes, in which each wound turn has been wound according to the optimum orientation calculated for the function which the wound part is to fulfill.

Thus, for example, in the case of deflection windings for cathode-ray tubes having turns wound on each semi-ring in the form of a truncated cone widened into a basin, said turns can be inclined on radial planes symmetrically on either side of the median plane of each semi-ring, with two symmetrical bundles of spirals clearly separated from the median plane on the small section of the basin and in contrast essentially contiguous on the large section.

The process of the invention making it possible to achieve these objectives is characterized in particular by the fact that the core to be covered by the winding is held on a support, rotatable at all times around an axis X. Each winder is mounted so that its winding arm can turn around said core and around an axis Z guided obliquely in relation to an axis Y, itself guided obliquely in relation to said axis X, and at all times the rotation position $\alpha$ of said support around said axis X and the rotation position $\beta$ of the axis Z around said axis Y is selected and guided in order to obtain the various required successive planes for winding the turns around the core.

Preferably, in practice the axes X and Y are selected fixed in relation to one another and guided essentially orthogonally, as are the axes Z and Y.

According to another characteristic of the process of the invention, each core to be wound, such as an essentially truncated cone-shaped ferrite semi-ring, is attached to its support, essentially in its median plane and on its smaller section, and a perfectly symmetrical winding of spirals inclined in relation to this median plane is achieved by selecting winding programs at symmetrical angles $\alpha$ and $\beta$.

The invention likewise concerns a machine making it possible to implement the aforementioned process, this machine being characterized by the fact that it includes:

- a bed-plate,
- at least one core support rotatable according to an angle $\alpha$ around an axis X fixed in relation to the bed-plate,
- at least one column supporting at least one winder mounted to turn on said column around an axis X fixed in relation to said column,
- said column being mounted to turn according to an angle $\beta$ in said bedplate around an axis Y fixed in relation to said bed-plate,
- said axes X, Y, and Z being guided obliquely in relation to one another. In practice and advantageously, the axes X and Y on the one hand and Y and Z on the other are arranged essentially orthogonally.

According to another characteristic of the machine referred to in this invention, it includes in addition:

- initial control means making it possible to select at all times the angle position $\alpha$ and to cause to turn incrementally said core support around the axis X,
- secondary means of control making it possible to select at all times the angle position $\beta$ and to cause to turn incrementally said column around said axis Y,
- and means for pairing said initial and secondary means of control in order to obtain the various successive desired planes for winding the turns around the core.

These pairing means consist advantageously of a microprocessor or computer storing the numbers of turns to be wound around the core for each value of the aforementioned determined angles $\alpha$ and $\beta$. The winding program thus established, according to any known means existing in the field and within the reach of the specialist, controls the various motors of the machine, specifically the winder motors and the step-by-step motors for determining the rotation angle $\alpha$ of the support around the axis X and the step-by-step motors for determining the rotation angle $\beta$ of the column around the axis Y.

The invention will appear more clearly with the aid of the following description, with reference to the attached drawings in which:

DETAILED DESCRIPTION OF THE INVENTION

Figure 1:
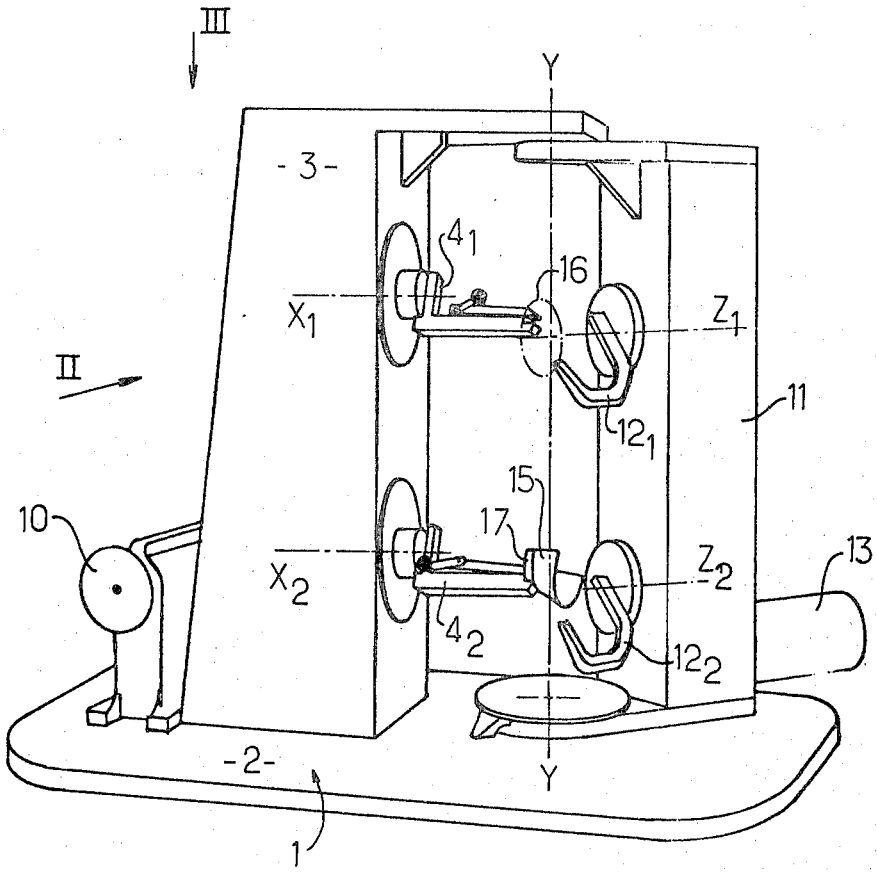
FIG. 1 is a diagrammatic perspective view of a machine designed according to the invention.

According to the mode of realization illustrated in the drawings, the machine includes a bed-plate 1 with a base 2 supporting a vertical standard 3 in which are mounted two supports $4_1$, $4_2$ rotatable according to an angle $\alpha$ around an axis $X_1$ and $X_2$ respectively, essentially horizontal as the plane of the base 2 in the example shown. For their rotation around the axes $X_1$ and $X_2$, the supports $4_1$, $4_2$ are diven by an electric motor with step-by-step control 5, the output shaft 6 of which drives two pulleys $7_1$, $7_2$ linked by a belt 8. The pulleys $7_1$, $7_2$ are keyed to on the drive shafts $9_1$, $9_2$ of the support arms $4_1$, $4_2$.

At 10 a wheel has been shown allowing manual control of the angle $\alpha$, and mounted at the end of the motor 5 axis.

The machine also includes a column 11 which in the example shown supports two classic winders, in which the arms marked $12_1$, $12_2$ are driven in rotation and simultaneously around the two parallel axes $Z_1$, $Z_2$, horizontal in the example shown. The winders $12_1$, $12_2$ are driven by a motor, the cap of which can be seen at 13.

Figure 2:
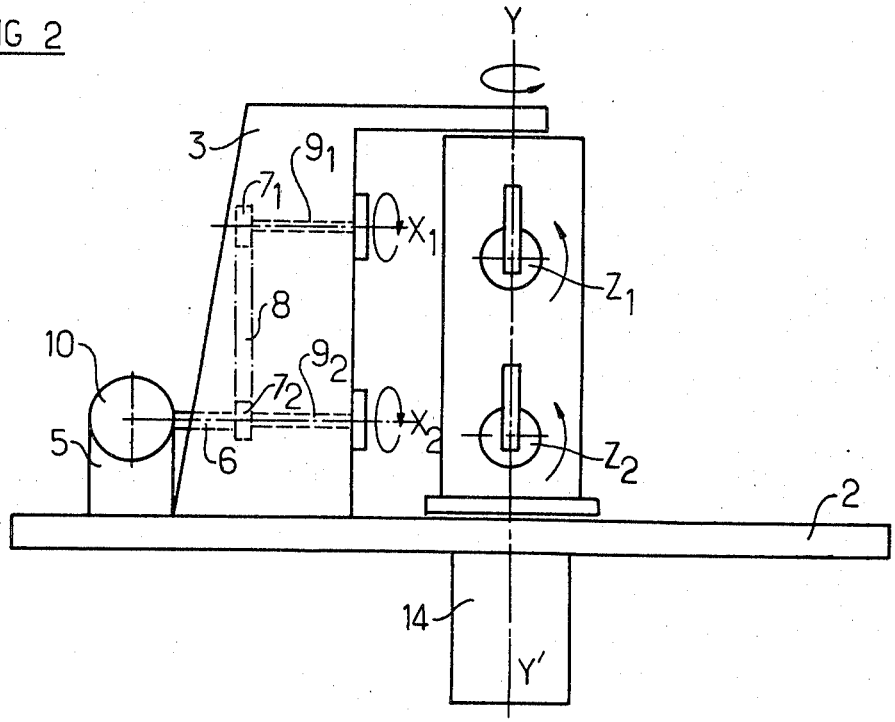
FIG. 2 is a side view along arrow II of FIG. 1.
Figure 3:
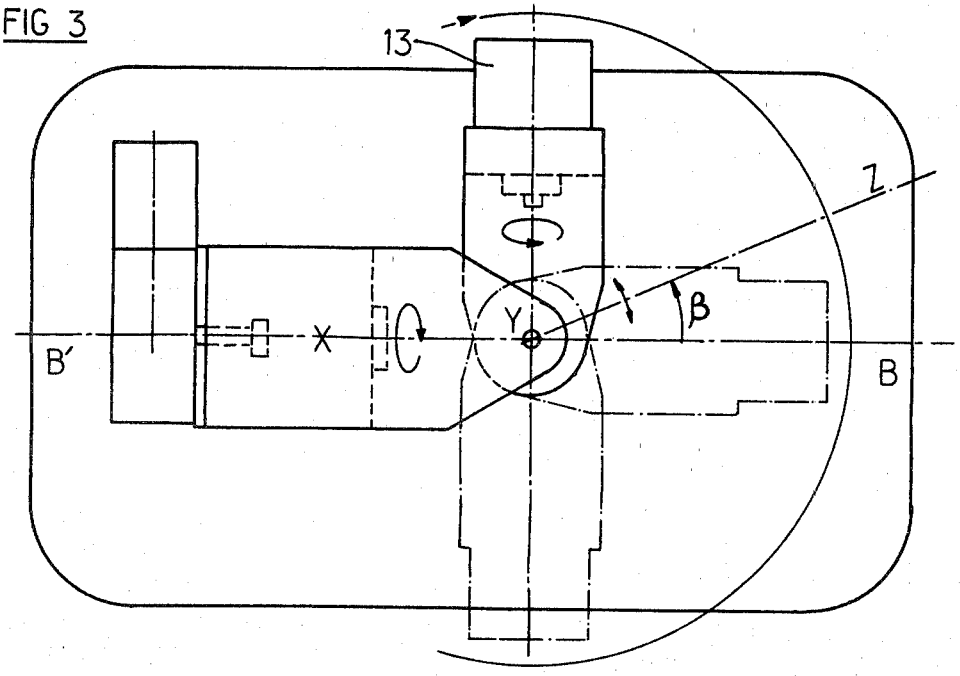
FIG. 3 is a top view of the machine along arrow III of FIG. 1.

Furthermore, the entire column 11 is mounted to turn according to an anble $\beta$ around an axis Y fixed in relation to the bed-plate and essentially vertical, i.e., perpendicular to the base 2 in the example shown. The rotation of the entire column around the axis Y is achieved by means of an electric motor with step-by-step drive, visible at 14 in FIG. 2.

It will be noted that the axis Y passes essentially at the point where, at the end of the supports $4_1$, $4_2$, the part to be wound may be presented, as for example the truncated cone-shaped ferrite semi-ring illustrated at 15, mounted onto the support $4_2$.

Obviously, the winder arms $12_1$, $12_2$ are likewise positioned on column 11 so that the winding plane cuts the part to be wound, allowing the winding. At 16 has been shown the circle described by the winding end of the arm $12_1$ turning around its rotation axis $Z_1$, this circle 16 obviously being contained in the winding plane.

Figure 8:
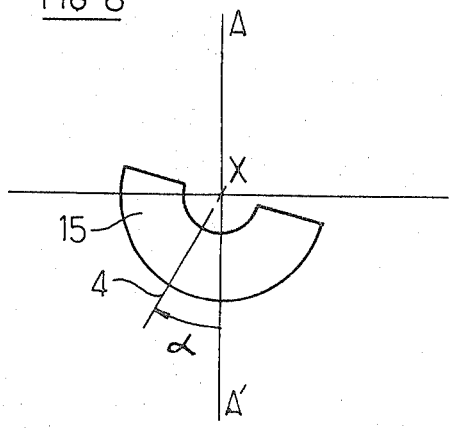
Figure 9:
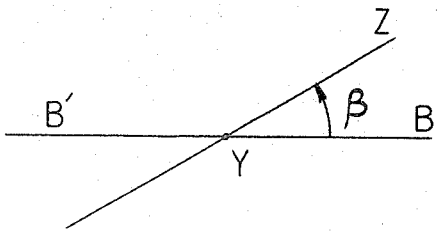

Comparison of the figures, and more particularly of FIGS. 1, 8 and 9, makes it possible to understand the winding process achieved according to the invention.

FIG. 8 illustrates the rotation angle $\alpha$ of the arm 4 supporting the part 15, seen from the axis X. The angle $\alpha$, for reasons of facility, may be located in relation to the vertical straight line A'a, parallel to the axis Y and passing through the axes $X_1$ and $X_2$.

Likewise, FIG. 9 shows the angular displacement $\beta$ of the column 11 around the axis Y. The angle $\beta$ can be located from the straight line B'B, which in the example shown is coincident with the projection on the base 2 of the axes $X_1$, $X_2$.

Furthermore, according to an advantageous mode of implementing the invention, the semi-ring 15 will be supported at the end of the support $4_1$, $4_2$, essentialy in its median plane and on its smaller section. In practice, the attachment may be achieved by gluing onto the truncated cone-shaped ferrite semi-ring 15 of plastic comb 17 which will have teeth 18 in which the wound turns 19 will be lodged, assuring proper positioning and avoiding any subsequent slippage. The support arm $4_2$ may be provided at its end with a clamp which will receive the median part of the comb.

With such an attachment of the semi-ring in its median plane and by its smaller section, it is then possible to achieve a perfectly symmetrical winding of turns 19, 19' (see FIGS. 4 and 5) inclined in relation to the median plane 20; the angle of inclination of the turns can be selected at any time by choosing the winding program, i.e., the paired angles $\alpha$ and $\beta$ utilized at all times, and the number of turns which must be made for each value of the aforementioned determined paired angles $\alpha$ and $\beta$.

Figure 4:
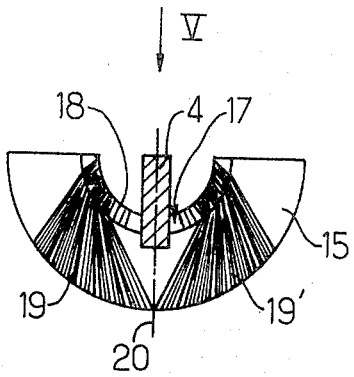
FIG. 4 is a view of a ferrite semi-ring wound according to the invention, this view being from above on the side of the smaller section essentially along arrow IV of FIG. 5.
Figure 5:
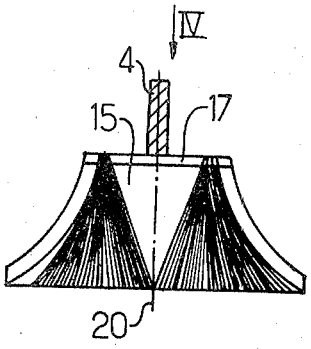
FIG. 5 is a view of the inside of the semi-ring of FIG. 4 essentially along arrow V of FIG. 4 and placed in the plane of FIG. 5.

In addition, it is immediately apparent that considering the attachement in a median position of the ring perfectly symmetrical turns 19, 19' will be obtained if care is simply taken to select identical winding programs for the symmetrical angles $\alpha$ and $\beta$. FIGS. 4 and 5 also illustrate the discontinuity of windings along the upper arcuate edge to which comb 17 is attached, between points equidistant from the median plane 20, while the windings are continuous along the lower arcuate edge.

Figure 6:
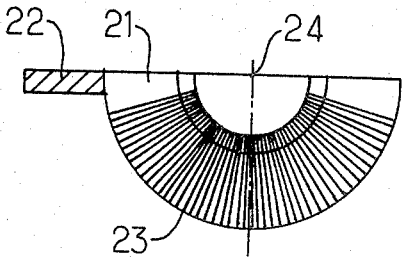
FIG 6 PRIOR ART
FIG. 6 shows, as in FIG. 4, a ferrite semi-ring wound according to the prior art.
Figure 7:
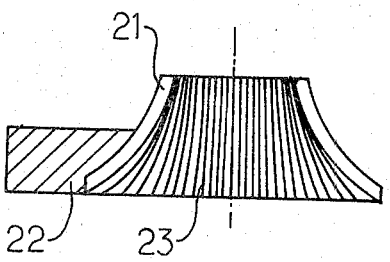
FIG 7 PRIOR ART
FIG. 7 shows, as in FIG. 5, the semi-ring of FIG. 6, FIGS. 8 and 9 are two angular diagrams illustrating how the rotation angles $\alpha$ and $\beta$ can be measured, respectively, in the support shaft of the machine and the support column of the winders.

If we now refer to FIGS. 6 and 7, we see that according to the prior art the core consisting of a ferrite semi-ring 21 was held by a clip 22, for example attached near an end section of the semi-ring 21, and onto the semi-ring thus held turns were wound in radial planes passing through the axis 24 of the semi-ring 21 by means of winding arms such as $12_1$, $12_2$. These various radial winding planes were obtained by making the winder arms pivot around the axis 24 of the ring held in place.

Electromagnetically, the coils thus obtained are a good deal less effective than when the turns are arranged in inclined planes as according to the invention.

Of course, the invention is in no way limited to the mode of realization illustrated and described, which has been given solely by way of example. On the contrary, the invention includes all the technical equivalents of the means described as well as their combinations if these are done according to its spirit and implemented within the framework of the following claims.

We claim:

1. A process for winding a semi-ring core having first and second arcuate edges, the method comprising the steps:

fastening the ring along a median plane;

positioning a single wire winding arm adjacent the ring;

rotating the arm about a first axis;

pivoting the arm about a second axis orthogonal to the first; and rotating the ring about a third axis, orthogonal to the second axis and oblique relative to the first axis, during pivotal rotation of the arm to wind wire symmetrically about the median plane, the windings being of increasing inclination as the median plane is approached for producing a winding continuous along a first arcuate edge and discontinuous along a second arcuate edge between points along the second arcuate edge equidistant from the median plane.

2. The method set forth in claim 1 wherein the second and third axes are maintained in orthogonal relation.

3. The method set forth in claim 1 wherein the first and second axes are maintained in fixed orthogonal relation.

4. The method set forth in claim 2 werein the first and second axes are maintained in orthogonal relation.

* * * * *